US005400690A

United States Patent [19]

Meili et al.

[11] Patent Number: 5,400,690

[45] Date of Patent: Mar. 28, 1995

[54] MULTI-RECEPTACLE PYROTECHNIC CARTRIDGES AND CORRESPONDING AMMUNITION

[75] Inventors: Gerard Meili, Bordeaux; Jean-Luc Pinchot, Saint Medard en Jalles, both of France

[73] Assignee: Societe Nationale des Poudres et Explosifs, Paris Cedex, France

[21] Appl. No.: 299,732

[22] Filed: Sep. 1, 1994

Related U.S. Application Data

[63] Continuation-in-part of Ser. No. 68,424, May 27, 1993, Pat. No. 5,359,918.

[30] Foreign Application Priority Data

Jun. 5, 1992 [FR] France ..... 92 06854

[51] Int. Cl.[6] ..... F41F 3/042; F41F 3/052; F41F 3/06

[52] U.S. Cl. ..... 89/1.816; 89/1.57; 89/1.59; 102/505

[58] Field of Search ..... 89/1.816, 1.818, 1.57, 89/1.59; 102/505

[56] References Cited

U.S. PATENT DOCUMENTS

| | | | |
|---|---|---|---|
| 3,437,039 | 4/1969 | Hawthorne | 102/438 |
| 3,708,563 | 1/1973 | Sells | 89/1.816 |
| 3,808,940 | 5/1974 | Schillreff et al. | 89/1.814 |
| 4,012,985 | 3/1977 | Magnusson | 89/1.818 |
| 4,063,485 | 12/1977 | Carter et al. | 89/1.816 |
| 4,222,306 | 9/1980 | Maury | 102/505 |
| 4,307,665 | 12/1981 | Block et al. | 102/505 |
| 4,601,445 | 7/1986 | Duclos et al. | 89/1.59 |
| 4,604,939 | 8/1986 | Hoffmeister et al. | 89/1.816 |
| 4,679,483 | 7/1987 | Wranå | 89/1.51 |
| 4,881,601 | 11/1989 | Smith | 89/1.59 |

*Primary Examiner*—David Brown
*Attorney, Agent, or Firm*—Bucknam and Archer

[57] ABSTRACT

The present invention falls within the sector of infrared or electrogmagnetic decoys for protecting light aircraft or helicopters. It relates more particularly to pyrotechnic cartridges and to ammuniton comprising racks receiving the cartridges. This invention makes it possible, for the same volume of ammunition, to have a larger number of shots and to carry out the loading of the ammunition simply and quickly. The cartridge (1), consists of a sole (2) fixed to a case (3), in which are accommodated a plurality of assemblies (11) comprising pyrotechnical ejection charges (6), pyromechanical assemblies (7), ignition charges (8), effective charges (9) and the caps (10). The case (3) is provided with a plurality of receptacles and comprises at its base either a blocking device (4) or a gasket which is seated in a groove (41). The assemblies (11) are independent and are arranged in parallel in the various receptacles of the case (3); the sole (2) is common to the various receptacles of the case (3) and comprises electrical fuses.

6 Claims, 5 Drawing Sheets

MULTI-RECEPTACLE PYROTECHNIC CARTRIDGES AND CORRESPONDING AMMUNITION

This application is a continuation-in-part of U.S. Ser. No. 068,424, filed May 27, 1993, now U.S. Pat. No. 5,359,918.

FIELD OF THE INVENTION

The present invention relates to the sector of passive infrared (I.R.) or electromagnetic (E.M.) countermeasures, for protecting platforms, such as light aircraft or helicopters, when they are threatened by missiles equipped, for example, with an IR or EM homing device, that is to say with a guidance system operating in the infrared or electromagnetic range. This protection is afforded by drawing the missile away from the platform by means of infrared or electromagnetic decoys.

The present invention relates more particularly to pyrotechnic cartridges containing a plurality of effective charges; after ejection, the combustion of these effective charges generates infrared radiation similar to the infrared signature of the platform to be protected, or, after ejection, the dispersal of these effective charges in the atmosphere generates a radar echo similar to the radar equivalent surface (R.E.S.) of the platform to be protected. The guidance system of the missile is decoyed by this device, and the missile is drawn away from the target platform.

The present invention also relates to the ammunition equipped with the said cartridges. It is placed in a decoy launcher fastened to the platform to be protected, the decoy launcher being connected to the fire-control box. The ammunition comprises a rack receiving the said cartridges, and a plate which on the one hand ensures the closing of the rack and on the other hand comprises the electrical connections to the decoy launcher and the electrical contacts with the cartridges.

The present invention also relates to ammunition equipped with the said cartridges and functioning as a decoy launcher; this ammunition is fastened directly to the platform and is connected to the fire-control box.

BACKGROUND OF THE INVENTION

The cartridges known hitherto comprise an effective charge or a plurality of effective charges arranged in series.

In the infrared range, the effective charges are grains of pyrotechnic substance produced from low-performance compositions, and these grains will therefore be of relatively large size in order to produce an infrared signature equivalent to that of the platform to be protected.

The disadvantages resulting from this are the large size of the cartridges, which limits their number for a given overall size of the ammunition. The ejection charges must be of high power, thus implying a sharp recoil when the shot is fired and necessitating reinforced and therefore heavier parts (such as the rack or the plate).

In the ammunition of the above described type known hitherto, the cartridges are fastened in the rack one by one by means of screws or elastic stop rings (circlips); the plate likewise closes the rack by screwing. The disadvantages of such devices are the loading difficulty, which necessitates a more or less specific tool, and the duration of this loading which is attributable to the numerous manipulations. Under these conditions, the reloading of the rack is impossible at the operations site.

SUMMARY OF THE INVENTION

To eliminate these disadvantages, one object of the invention is to reduce the size of the cartridges and optimise their stowage in order to increase the number of shots available for the same overall size of the ammunition and for the same decoy effect (infrared signature and radar equivalent surface).

Another object of the invention is to simplify the loading or reloading operation so that it takes place without recourse to a tool and in a limited number of manipulations, in order to reduce the duration of this operation considerably; reloading at the operations site or in the immediate vicinity is thus practicable.

The cartridge according to the invention contains a plurality of effective charges which are ejected by pyrotechnic means. The cartridge consists of a sole fixed to a case, in which is accommodated a plurality of assemblies comprising pyrotechnic ejection charges, pyromechanical assemblies, ignition charges, effective charges and caps. The cartridge is characterized in that the case is provided with a plurality of receptacles and comprises at its base a device for blocking in a rack, the above mentioned assemblies are independent and are arranged in parallel in the various receptacles of the case, and the sole is common to the various receptacles and comprises electrical fuses. The pyromechanical device comprises a pyrotechnic delay and operating safeguards for initiating the ignition charge which will itself initiate the combustion of the effective charge, the safeguards interrupting this chain in the event of operating anomalies (for example, a non-ejected assembly).

According to one embodiment of the invention, the device for blocking the cartridge in the rack consists of a bead located at the base of the case. By the base of the case is meant the side of the case located near the sole. This bead moreover ensures sealing between the rack and the cartridge.

According to another embodiment of the invention, the device for blocking the cartridge in the rack consists of a gasket seated in a groove located at the base of the case. This gasket moreover ensures sealing between the rack and the cartridge.

The case of the cartridge according to the invention comprises an odd number of receptacles. The method of positioning in the rack is unimportant. The number of receptacles of the case is preferably equal to three.

According to a preferred embodiment, the cartridge according to the invention is such that the case consists of a plurality of receptacles produced by the injection moulding of a reinforced plastic onto the sole. This plastic is advantageously electrically conductive.

According to an embodiment of the invention, the effective charge of the above mentioned assembly consists of a grain of pyrotechnic substance of high radiation in the infrared range in the event of its combustion. By high radiation is to be meant a radiation equal to or greater than 60 J per gram of substance burnt, this energy being measured in band II of 3 to 5 $\mu$m.

According to another embodiment of the invention, the effective charge of the above mentioned assembly consists of products capable of generating a radar echo when they are dispersed in the atmosphere, after ejection. The products are metallic or metallised chaff or fibres, and they are known in the state of the art.

The rack, loaded with its cartridges, is fastened to the plate. This plate ensures that the rack is closed, and it makes it possible to identify the type of effective charges of the cartridges (effective charge producing infrared radiation or generating a radar echo) by means of devices known in the state of the art. This plate also makes the electrical connection between the platform receiving the ammunition and the fuses of the cartridges.

The ammunition, comprising a plate and a one-piece rack, is such that this rack comprises cells intended for receiving and blocking the cartridges, such as those described above.

Advantageously, the ammunition according to the invention simultaneously contains cartridges of effective charges radiating in the infrared range and cartridges of effective charges capable of generating a radar echo.

Advantageously too, the ammunition receives cartridges, the length of which is greater than the depth of the cells of the rack. This arrangement allows a rapid unloading of the rack.

According to a preferred embodiment of the ammunition, the one-piece rack loaded with its cartridges is fastened to the plate by means of a closing system comprising at least one quick-action hinge.

Advantageously, the closing of the plate on the rack is carried out by means of at least one quick-action hinge and one catch.

Preferably, the rack comprises a retractable grip for handling the ammunition and for controlling the release of the ammunition of the decoy launcher.

Advantageously, this ammunition comprises a first gasket arranged at the rear of the rack and ensuring sealing between the rack and the closing plate, and a second gasket placed around the rack and ensuring sealing between the rack and the decoy launcher.

In a particular embodiment of the ammunition, the rack, loaded with its cartridges and fastened to its plate, is mounted directly on the platform to be protected, that is to say, the ammunition is not fastened in a decoy launcher, but itself constitutes the decoy launcher. It is fastened to the aircraft by means of pins or shackles or any other device present on the aircraft. It is connected to the firing station by means of a cable and a connector which is connected to a connector arranged on the plate, for example one of its ends.

Preferably, the rack is profiled aerodynamically, thus reducing the drag attributable to the ammunition attached to the platform.

The aerodynamic profiling of the rack comprises a rounded fairing for the leading edge and a dihedral fairing at the trailing edge. Preferably, the fairings of the leading edge and of the trailing edge can extend over the entire height of the cartridges. Advantageously, the rack can form a lateral fairing of a height equal to that of the cartridges.

Advantageously, an oblong orifice is made in part of the fairing of the trailing edge, in order to provide a handling grip integrated in the rack. The various sharp edges are chamfered or rounded to make this grip convenient to use.

According to a preferred method of production, the ammunition rack is produced by the injection moulding of a reinforced plastic. This plastic is advantageously electrically conductive.

The invention is explained in more detail below by means of figures illustrating a particular embodiment.

Figure 1:
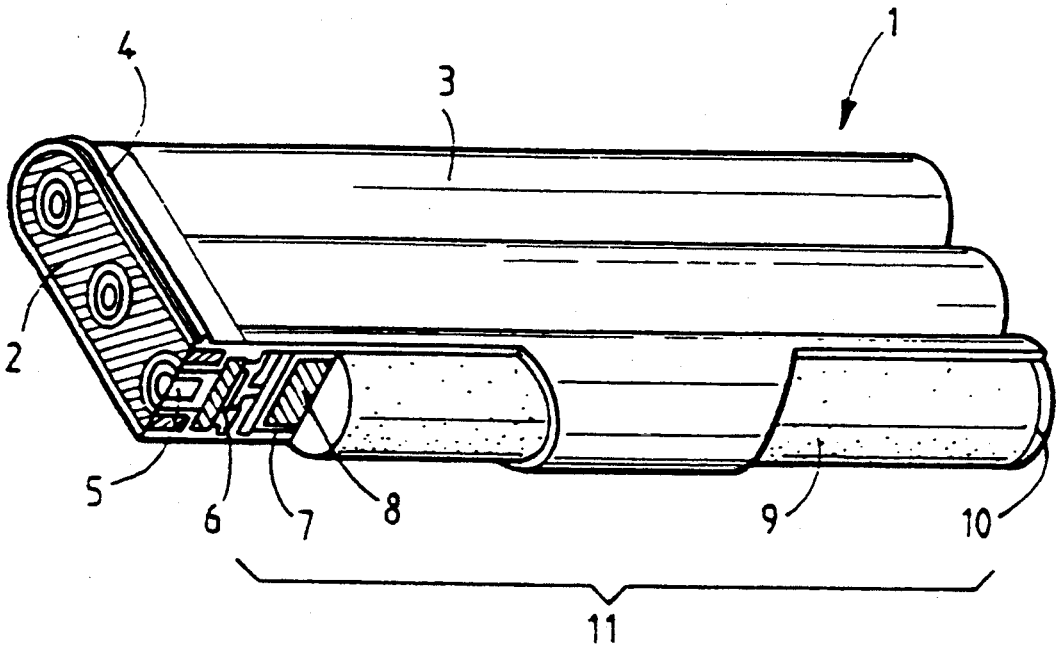
FIG. 1 shows a partially exploded perspective view of a cartridge, the case of which consists of three lobes forming three receptacles.

FIG. 1 illustrates a cartridge ( 1 ), the effective charge (9) of which is a grain of pyrotechnic substance radiating in the infrared range in the event of its combustion. This cartridge comprises a sole (2) and a case (3). This case (3) comprises a bead (4) at its butt (the end on the same side as the sole) and over its entire outer periphery. The sole (2) receives the electrical fuses (5), one for each of the receptacles of the case. Located in each receptacle (after the electrical fuse (5)) are an ejection charge (6), a pyromechanical assembly (7) (pyrotechnic delay and operating safeguards), an ignition charge (8), the effective charge (9), the receptacle finally being closed sealingly by means of a cap (10).

When the effective charge (9) is of the electromagnetic type, the assembly (11) is reduced to an ejection charge (6); the pyromechanical device is replaced by a simple piston ensuring the ejection of the effective charge (9). This effective charge consists of metallic or metallised chaff or fibres, the receptacle being closed sealingly by means of a cap (10).

The case (3) and the bead (4) are produced, in this example, by the injection moulding around the sole (2) of a polyether reinforced with glass fibres and made conductive.

The grain of radiating pyrotechnic substance is produced from a magnesium/polytetrafluoroethylene/epoxy composition employed by compression or extrusion. This grain has external combustion or internal combustion when it comprises a central channel.

The ignition charge (8) is a magnesium/polytetrafluoroethylene/fluorinated-elastomer composition.

The electrical pulse supplied by the decoy launcher initiates the electrical fuse (5); this fuse is of the "1 ampere/1 watt/5 minute non-fire" type present in the catalog. The latter ignites the ejection charge (6) which, on the one hand, ejects from a receptacle of the case (3) the stack (11) composed of the pyromechanical assembly (7), of the ignition charge (8), of the effective charge (9) and of the cap (10) and, on the other hand, ensures the ignition of a pyrotechnic delay incorporated in the pyromechanical assembly (7).

At the exit of the case (3), a muzzle safeguard device forming part of the pyromechanical assembly (7) ensures alignment between the pyrotechnic delay and the ignition charge (8), and the latter subsequently brings about the combustion of the grain of pyrotechnic-substances forming the effective charge (9). The alignment between the pyrotechnic delay and the ignition charge (8) is interrupted by another safeguard device if the "pyromechanical device/ignition charge/effective charge" assembly encounters an obstacle in the vicinity of the ejection point. The above mentioned safeguard devices are of the type conventionally used in this sector.

Figure 2:
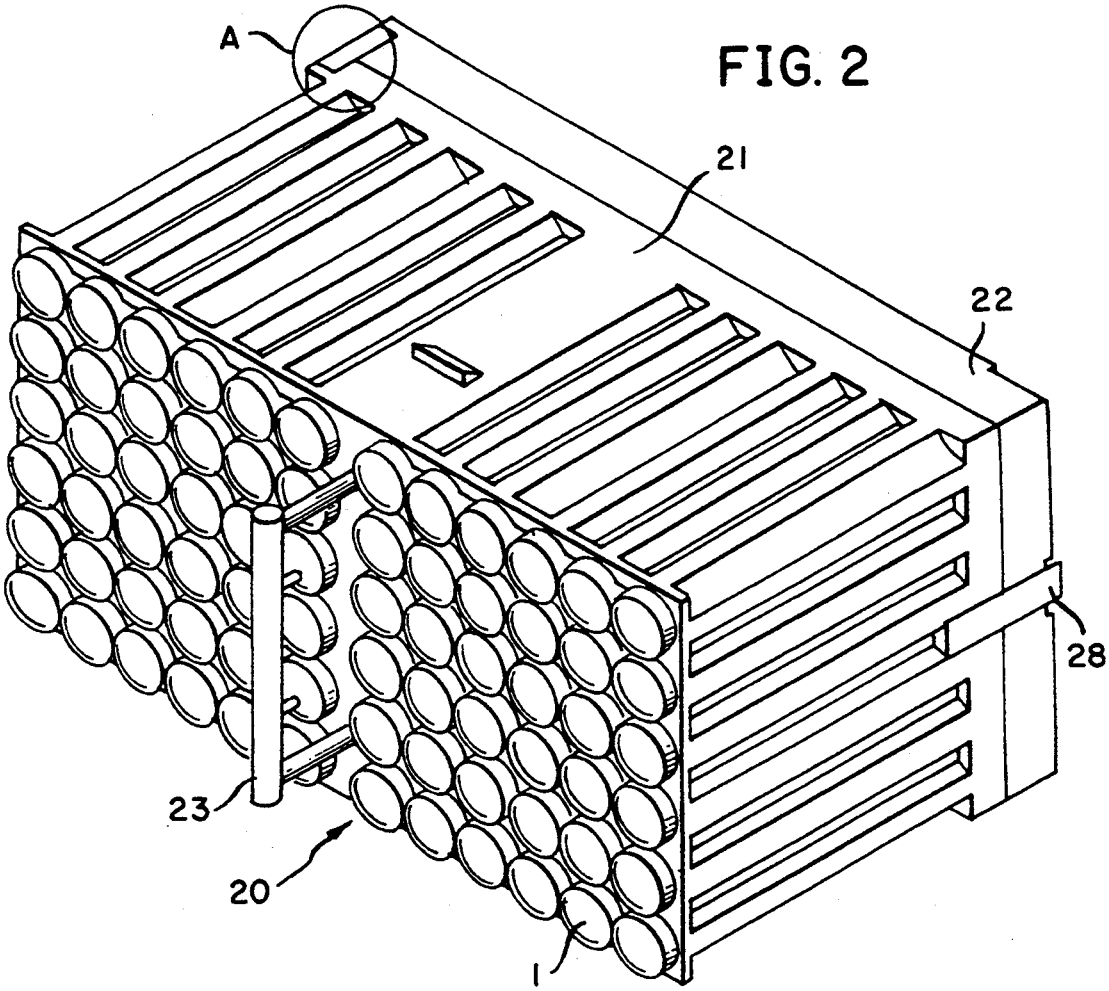
FIG. 2 shows an axonometric perspective view of the ammunition loaded with its three-lobe cartridges and closed via the plate, the ammunition being shown as having left the decoy launcher, the latter not being shown.

FIG. 2 illustrates the ammunition (20) consisting of a rack (21) which receives the cartridges (1), this figure showing 24 cartridges, each consisting of three lobes and comprising three receptacles, thus representing 72 available shots. The rack (21) is closed by means of the plate (22). The retractable grip (23) (shown in the open position) serves for handling the ammunition, and it also controls the device for releasing the ammunition and the decoy launcher. The plate (22) is articulated and is fastened to the rack by means of a quick-action hinge (25).

Figure 4:
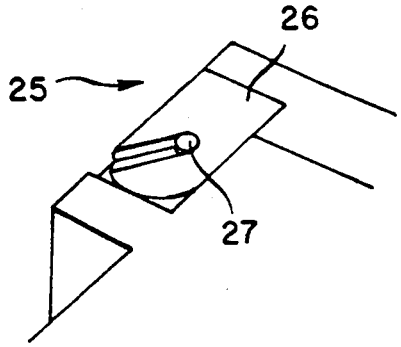
FIG. 4 is a detailed view of the part A of FIG. 2.

The enlargement illustrated in FIG. 4 shows this part in detail; the tab (26) fixed to the plate comprises an open-ended oblong slot inclined relative to the axis of the tab; this slot engages in a stud (27) fixed to the rack (21), this stud forming the axis of rotation of the hinge. In the example shown, the plate comprises two identical hinges located at the ends of the same side of the plate. The plate is closed and locked on the rack by means of the elastic catch (28) fixed to the rack in this example. This simple and light form of construction can be achieved as a result of the low recoil force when the cartridges operate.

Figure 3:
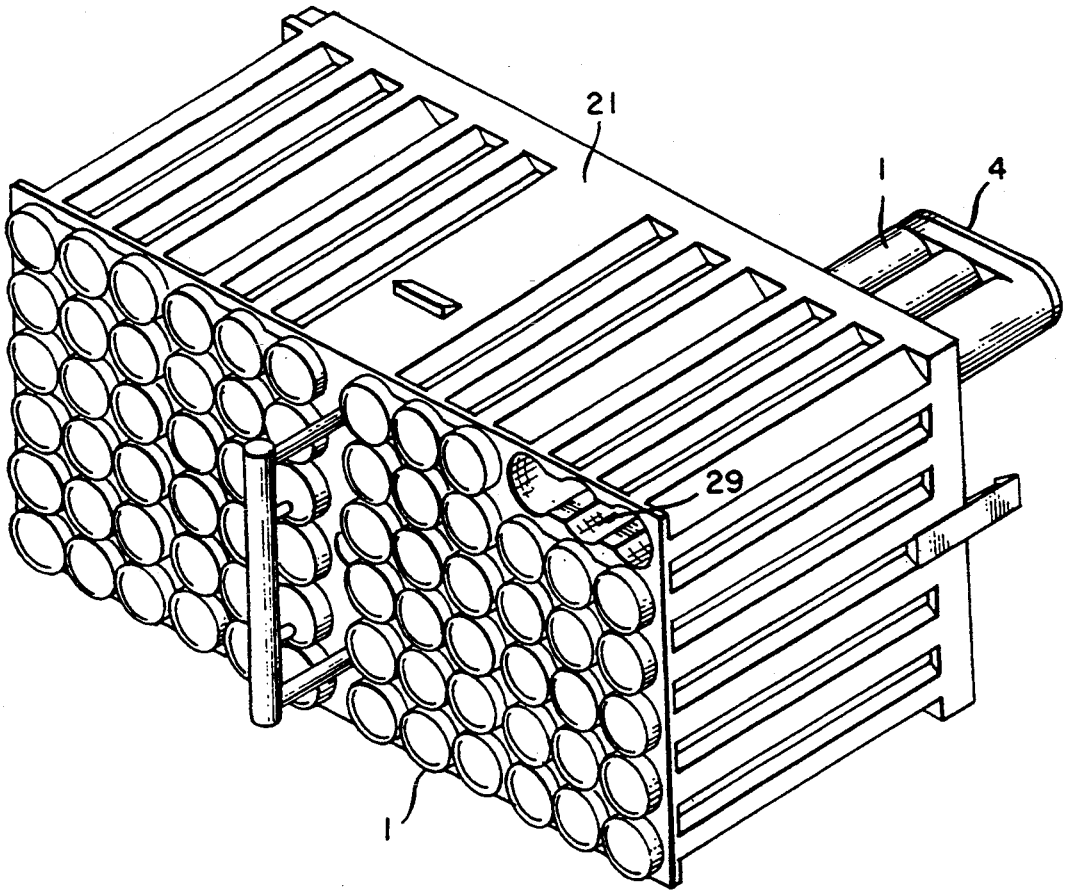
FIG. 3 shows, in the same way as before, the ammunition loaded with its cartridges, the last cartridge being engaged partially into its cell, the plate having been removed and not being shown.

FIG. 3 shows the rack (21) (the plate (22) is removed), all the cartridges being in place, except one which is shown partially engaged into the cell (29), of which the shape suitable for receiving the cartridges (1) can be seen. The bead (4) of the cartridge (1) ensures a force fit sufficiently firm to prevent the cartridge from falling out if the rack is overturned, but sufficiently weak for this force fit to be made by hand. The cells (29) of the rack have at their rear end a shoulder which serves as an abutment for the butt of the cartridge.

On the other hand, the cartridges have a length greater than the depth of the rack and project on the front face of the rack when they are in abutment on the shoulder. This arrangement makes it possible to extract them very quickly in order to withdraw them from the rack. When the plate is removed, it is sufficient to push on the projecting part of the cartridge in order to cause it to slide out of the cell (the bead is thus released), and the cartridge is then withdrawn from the cell.

Figure 5:
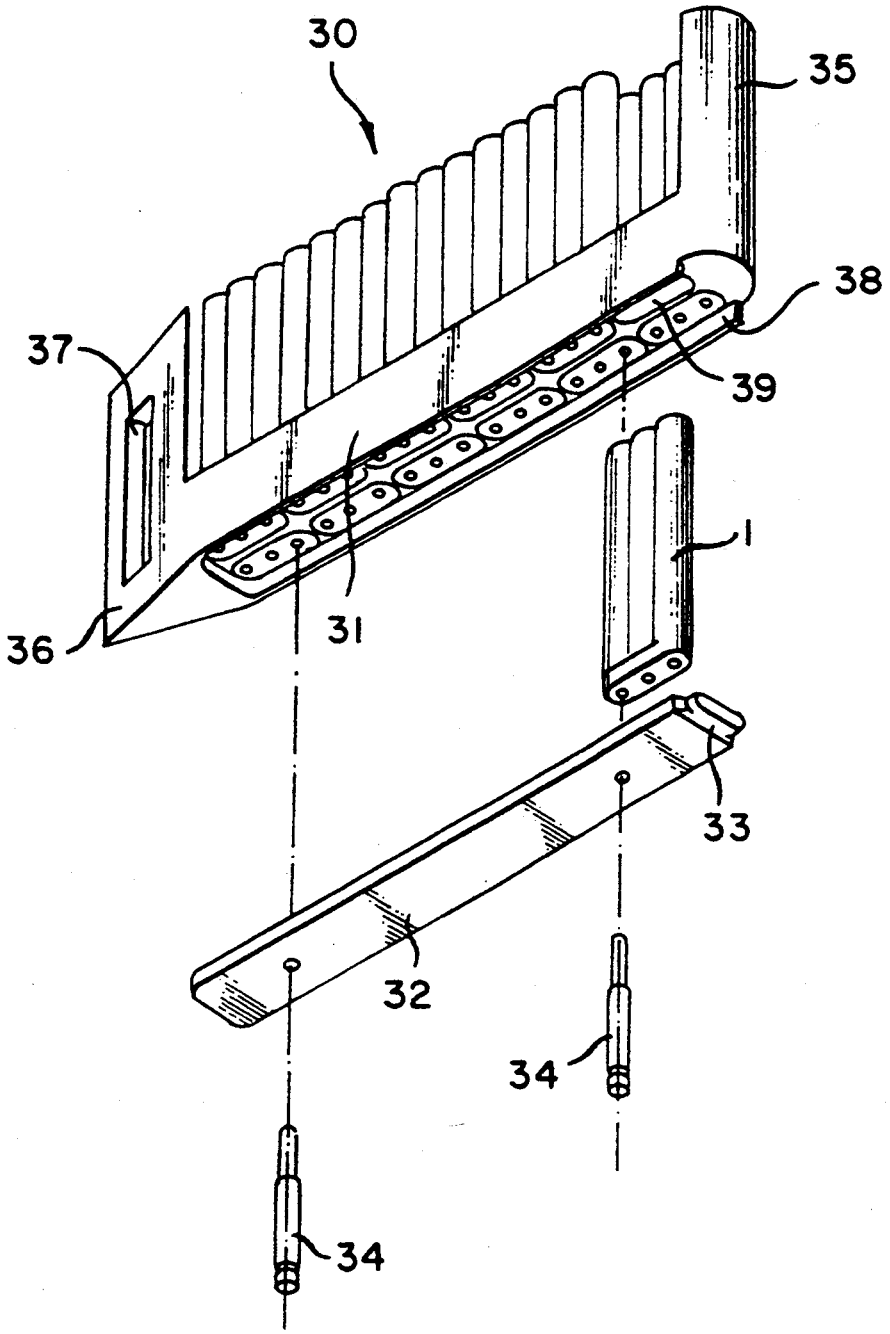
FIG. 5 shows a partially exploded perspective view of ammunition forming a decoy launcher.

FIG. 5 shows an exemplary embodiment of the invention in which the ammunition (30) also constitutes the decoy launcher; the ammunition is fastened directly to the platform to be protected and is connected to the fire-control station by means of an electrical cable.

The ammunition is shown partially dismantled, and there are:

- the rack (31) equipped, in this example, with two rows of six cartridges, such as those described above; only the last cartridge (1) is shown not engaged into the cell (39) intended for receiving it,
- the plate (32) which ensures on the one hand the closing of the rack and on the other hand the electrical contacts with the fuses of the cartridges, one of the ends of the platecomprising a connector (33), to which is connected the cable making the connection with the firing station,
- the pins (34) on the one hand fasten the plate to the rack and on the other hand serve for fastening the ammunition to the platform to be protected.

The rack is produced in an identical way to the example described above, particularly with regard to the shape and dimensions of the cells (39) (depth of the cells (39) smaller than the length of the cartridges (1)). As in the preceding example, this rack is produced by injection moulding.

However, the fastening of the plate (32) to the rack (31) takes place differently here. The plate (32) engages into a cell (38) at the base of the rack, and the pins (34) fasten it to the rack.

Finally, the rack is profiled. This profiling is obtained in a very simple way by means of a rounded shape (35) on the leading edge and by means of an acutely dihedral shape (36) on the trailing edge. Moreover, an oblong orifice (37) is made in the trailing edge. This provides a handling grip incorporated in the rack; the various edges are chamfered or rounded to make this grip convenient to use.

Figure 6:
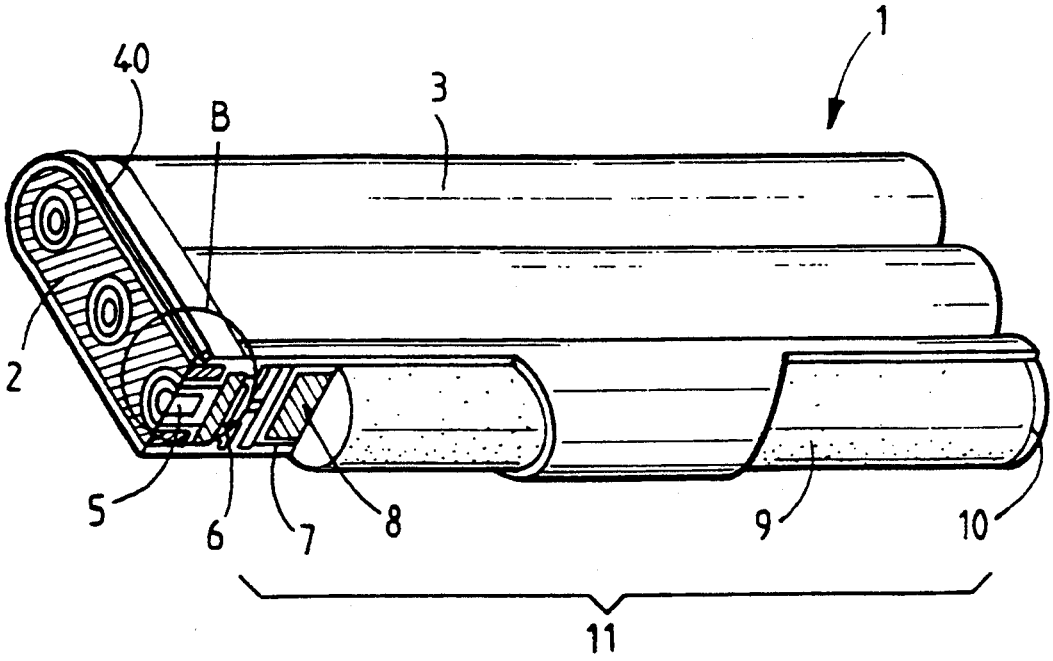
FIG. 6 shows the gasket (40).

FIG. 6 illustrates the embodiment according to which the blocking of the cartridge to the rack consists of a gasket (40) which is seated in a groove (41).

Figure 7:
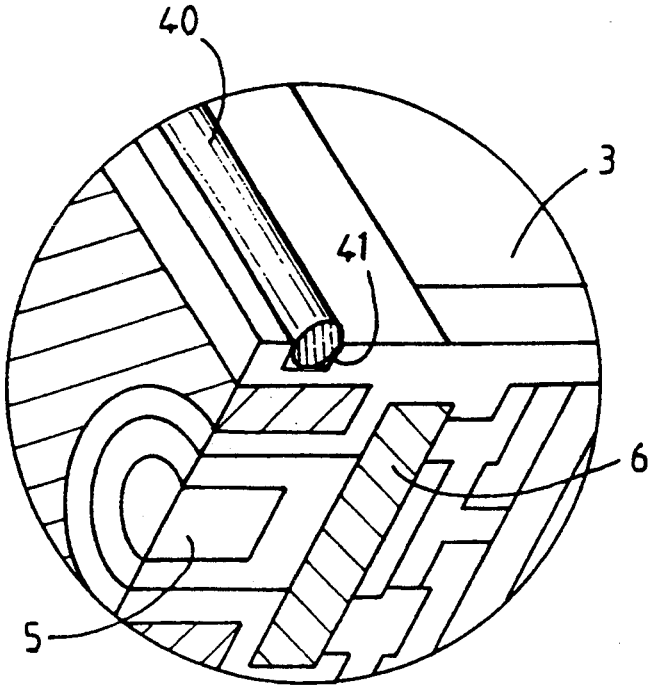
FIG. 7 shows the gasket (40) and the groove (41).

FIG. 7 shows the detail marked B in FIG. 6 and specifically how the gasket (40) is seated in the groove (41).

What is claimed is:

1. An ammunition (20) comprising a rack (21), said rack receiving a plurality of cartridges (1), each cartridge consisting of a case (3), a sole (2) fixed to said case, a plurality of receptacles within said case, a plurality of assemblies (11) accommodated in said receptacles, each of said assemblies comprising a pyrotechnical ejection charge (6), a pyromechanical device (7), an ignition charge (8), an effective charge (9) and a cap, said assemblies being independent and being arranged in parallel in said receptacles, each assembly comprising one electric fuse (5), said electrical fuses being received in said sole (2), said sole (2) being common to said receptacles, each of said cases having a base, a groove (41) located at the base of each of said cases, a gasket (40) seated in each of said grooves, each of said gaskets (40) blocking said cartridges to said rack and ensuring sealing said cartridges to said rack.

2. The ammunition according to claim 1 which comprises a plate (22), said plate being fastened to said rack, wherein said rack comprises cells (29) intended for receiving said cartridges and a device consisting essentially of one catch (28), said catch (28) being fixed to said rack, and at least one quick action hinge (25) for fastening said rack to said plate.

3. The ammunition according to claim 2, wherein said cartridges have a length and the length of the cartridges is greater than the depth of said cells (29).

4. An ammunition (20) comprising a rack (21), said rack receiving a plurality of cartridges (1), each cartridge consisting of a case (3), a sole (2) fixed to said case, a plurality of receptacles within said case, a plurality of assemblies (11) accommodated in said receptacles, each of said assemblies comprising a pyrotechnical ejection charge (6), a pyromechanical device (7), an ignition charge (8), an effective charge (9) and a cap (10), said assemblies being independent and being arranged in parallel in said receptacles, each assembly comprising one electric fuse (5), said electrical fuses being received in said sole (2), said sole (2) being common to said receptacles, each of said cases having a base, each of said cases having a bead (4) located at the base of said case, each of said beads blocking said cartridges to said rack and ensuring sealing said cartridges to said rack.

5. The ammunition according to claim 4 which comprises a plate (22), said plate being fastened to said rack, wherein said rack comprises cells (29) intended for receiving said cartridges and a device consisting essentially of one catch (28), said catch (28) being fixed to said rack and at least one quick action hinge (25) for closing said rack to said plate.

6. The ammunition according to claim 5, wherein said cartridges have a length and the length of the cartridges is greater than the depth of said cells (29).

* * * * *